US006694656B2

(12) United States Patent
Flodin et al.

(10) Patent No.: US 6,694,656 B2
(45) Date of Patent: Feb. 24, 2004

(54) FRAME SYSTEM FOR OBJECT DISPLAY

(75) Inventors: James E. Flodin, Hope, RI (US); Albert W. Seifert, Mystic, CT (US)

(73) Assignee: Greene Plastics Corporation, Hope Valley, RI (US)

( * ) Notice: Subject to any disclaimer, the term of this patent is extended or adjusted under 35 U.S.C. 154(b) by 0 days.

(21) Appl. No.: 10/166,869

(22) Filed: Jun. 11, 2002

(65) Prior Publication Data

US 2003/0226302 A1 Dec. 11, 2003

(51) Int. Cl.[7] ..... A47G 1/06
(52) U.S. Cl. ..... 40/781; 40/748; 40/757
(58) Field of Search ..... 40/746, 748, 757, 40/781, 768

(56) References Cited

U.S. PATENT DOCUMENTS

| | | | | | |
|---|---|---|---|---|---|
| 1,338,441 | A | | 4/1920 | Haley | |
| 2,448,580 | A | * | 9/1948 | Crosby | 40/748 |
| 2,477,470 | A | | 7/1949 | Williams | 40/158 |
| 2,505,250 | A | | 4/1950 | Kime et al. | 40/152 |
| 2,614,354 | A | | 10/1952 | Winslow | 40/156 |
| 2,697,889 | A | * | 12/1954 | Heim | 40/706 |
| 2,806,309 | A | | 9/1957 | Goldberg | 40/152 |
| 2,841,903 | A | | 7/1958 | Christensen | 40/152 |
| 4,212,122 | A | * | 7/1980 | Reim | 40/757 |
| 4,949,483 | A | * | 8/1990 | Dobson et al. | 40/740 |
| 5,012,601 | A | * | 5/1991 | Garland et al. | 40/781 |
| 5,081,777 | A | * | 1/1992 | Kim | 40/781 |
| 5,253,440 | A | * | 10/1993 | Chang | 40/748 |
| 5,419,063 | A | * | 5/1995 | Lane | 40/746 |
| 5,524,370 | A | * | 6/1996 | Roy | 40/748 |
| D452,618 | S | | 1/2002 | McDaniel et al. | D6/300 |
| 6,354,031 | B1 | * | 3/2002 | Meur | 40/781 |

* cited by examiner

*Primary Examiner*—Gary Hoge
(74) *Attorney, Agent, or Firm*—Albert W. Hilburger

(57) ABSTRACT

A frame system for object display includes a main frame with a frame face defining an opening for viewing a display object, a peripheral wall projecting away from the frame face and having first and second opposed segments, the segments formed with first and second female locking features, respectively, a receiving surface for the display object and an easel back selectively mountable on the main frame including a support assembly including a planar support panel and opposed male locking features on the peripheral edge interferingly engageable, respectively, with the female locking features on the opposed segments when the easel back is mounted onto the main frame. The support assembly includes a central panel for biasing the display object into engagement with the receiving surface and a web member extending transverse of the planes of the central panel and the support panel and joining the central panel and the support panel.

12 Claims, 6 Drawing Sheets

FIG.15
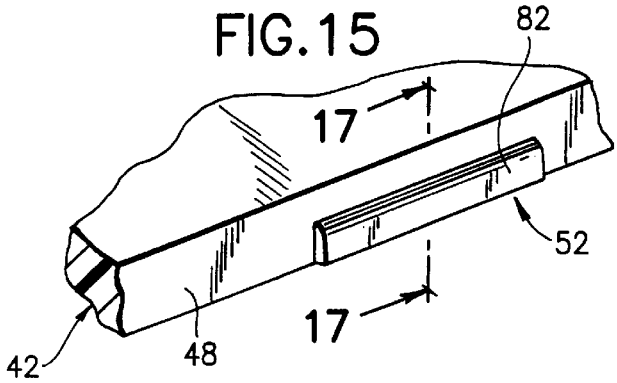
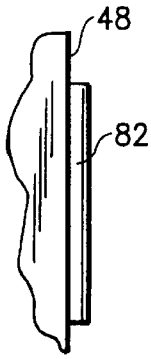
FIG.16
FIG.17
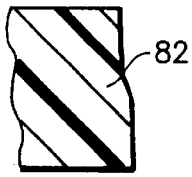
FIG.21
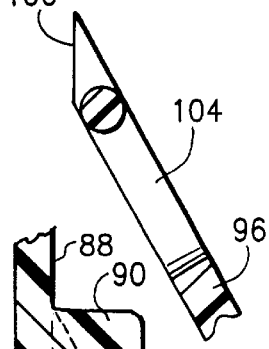
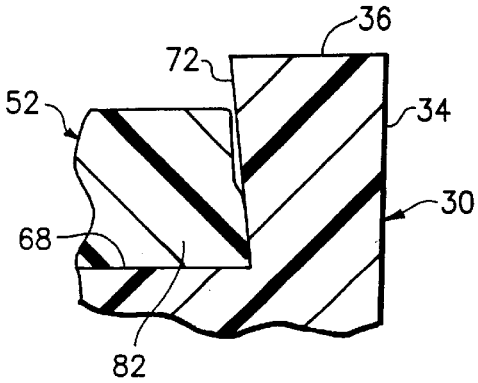
FIG.18
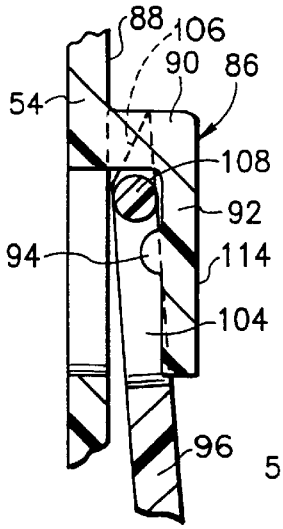
FIG.19
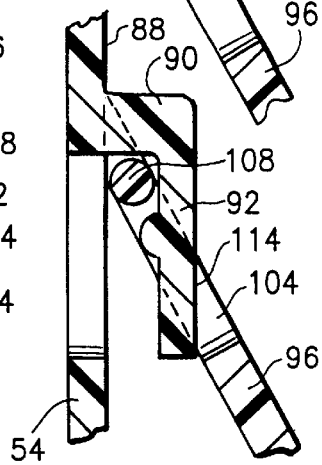
FIG.20

FRAME SYSTEM FOR OBJECT DISPLAY

BACKGROUND OF THE INVENTION

1. Field of the Invention

The present invention relates generally to a frame system for the presentation of a display object such as photographs, paintings, certificates, and the like, and, more particularly, to a frame system in which a display object may be easily positioned, protected, and removed.

2. Description of the Prior Art

Objects to be displayed are generally considered valuable by their owner and it is important to their owner that they be displayed in a manner which will both protect them and enhance their presentation.

There are numerous disclosures of advances in the field of frame systems over the years. Typical of disclosures of successive generations are, in sequence, U.S. Pat. No. 1,338,441 to Haley which issued Apr. 27, 1920, U.S. Pat. No. 2,614,354 to Winslow which issued Oct. 21, 1952, and U.S. Pat. No. 6,354,031 to Meur which issued Mar. 12, 2002. An allied field of endeavor concerns the mounting of photographic transparencies which often require similar concepts for rapidly positioning, protecting, and removing the subject matter to be presented. In this regard, of interest are U.S. Pat. No. 2,841,903 to Christensen, U.S. Pat. No. 2,806,309 to Goldberg, U.S. Pat. No. 2,697,889 to Heim, U.S. Pat. No. 2,505,250 to Kime et al., and U.S. Pat. No. 2,477,470 to Williams.

It was with knowledge of the foregoing disclosures representative of the state of the art that the present invention was conceived and has now been reduced to practice.

SUMMARY OF THE INVENTION

The present invention relates to a frame system for object display which includes a main frame with a frame face defining an opening for viewing a display object. A peripheral wall projects away from the frame face and has first and second opposed wall segments formed with first and second female locking features, respectively. A receiving surface for the display object and an easel back selectively mountable on the main frame includes a support assembly with a planar support panel and opposed male locking features on the peripheral edge interferingly engageable, respectively, with the female locking features on the opposed wall segments when the easel back is mounted onto the main frame. The support assembly includes a central panel for biasing the display object into engagement with the receiving surface and a web member extending transverse of the planes of the central panel and the support panel and joining the central panel and the support panel.

A basic intent of the invention is to provide an economical, unique plastic picture frame and components which are injection molded, including frame face, easel back, support arm, and transparent window pane. The components are designed to fit and snap together without use of tools or additional fasteners. The frame and easel back in each instance has a simple molded-in, decoupling locking feature with positive feedback. The snap-fit is secure, yet allows for disassembly and re-use many times. Molds for the frame system components with the unique locking feature have no moving cams or lifters, which would add to cost and complexity of mold design and leave unsightly witness lines on frame face and side surfaces.

The preferred material for the frame face, polystyrene, is able to accept a large variety of colorants, so frame faces according to the invention can be transparent with or without color, translucent with or without color, opaque, glow-in-the-dark, molded-in pearlized, mottled, or transparent with glitter or other effects. The usual materials for snap-fit, decoupling plastic components for known frame designs are either much more costly than styrene or have inherent limitations on colors and effects, such as impact styrene which cannot be made transparent.

Various sizes and unique shapes of frames are possible when using plastics, such as polystyrene, which are not subject to some of the form limtations of other materials such as wood or metal.

The easel back for the frame system of the invention is designed, with the support leg removed, to be flush with the rear of the frame face so the frame can be hung flush on a wall or other upright supporting surface. The molded in hangers are located to be hidden from the front view in transparent or clear frames. Additionally, the easel back is preferably formed with a step, or recessed, such that it fits into an inside rim of the main frame, taking up the space where cardboard spacers are customarily required to hold the picture firmly against the window pane, and thereby eliminating the need for such spacers. An especially important factor with the easel back design of the invention is that the easel back drops straight down onto the main frame rather than sliding into place in the manner of many known frame systems. Such a construction makes it easier to enhance clear frame faces by filling the space around the picture or other object to be displayed with decorative materials such as silk flowers. The described construction also allows for an infinite number of shapes without requiring straight sides as would be necessarily required if the back is of the type that slides into place.

A primary feature of the invention is the locking feature which is intended to be as simple as possible. The locking feature employs molded in details on both the main frame and easel back. On the main frame, for example, the locking feature may take the form of a surface having dimensions of 0.312 inches long×0.125 inches deep with an outwardly negative 3-degree angle formed in the inside surface of the peripheral wall of the main frame. Preferably, two of these locking features are placed along each long side of the rectangular or irregular shaped main frame members. Again in an exemplary but not restrictive fashion, mating male locking rib members on the easel back are 0.050 thick, and protrude from the easel back 0.006. Each rib member may have a straight wall with a 0.020 radius on the bottom face. The top of the rib member may have a square corner in order to lock with the angled female feature on the inside surface of the peripheral wall of the main frame.

Material selection for the components of the invention was a major concern, because of the requirement for the components to flex and return the male and female locking features to the normal position many times. While it is preferable for the main frame to be comprised of 100% polystyrene, the easel back component may be molded of 50% polystyrene and 50% impact styrene. The locking feature has also been designed to be capable of decoupling. Thus, the frame system is disassembled by pressing on the transparent window pane to release the easel back, remove, and add a new display object the thickness of both the easel back and main frame was also a main consideration. Walls of the main frame have to be thick enough not to fracture, while the window pane and easel back are thin enough to flex without breaking. Different thicknesses were experimented with, arriving at a preferred thickness to enable the wall to flex slightly without fracturing when inserting the easel back. The wall thickness was also critical during the molding operation. The wall had to be pliable enough to release from the 3-degree angle undercut without breaking or scraping during ejection from the mold. The wall thickness also had to be thick enough to allow it to shrink back during the curing period to the same shape as molded. This memory factor is critical to both achieving the locking fit and properly forming the components of the frame system.

Positive feedback is obtained from use of the locking feature of the invention. When the main frame and easel back components are pressed into place, the easel back is seated on two rim shelves which are incorporated in the main frame and the construction is such that a user can both feel and hear when the easel back is snapped into place.

The rear support leg is designed to be removed and re inserted easily, enabling the display object to be viewed straight up (in portrait orientation) or sideways (in landscape orientation). The easel back and support leg are also molded, preferably, of 50% styrene and 50% impact styrene.

The transparent window pane is molded of dear polystyrene. The mold gate region of the window is moved into the rim of the window, 0.045 inches, for example, to allow the gate to be snapped off and not leave any gate vestige extending beyond the rim. This manner of manufacture assures the window will fit without resistance into the opening for the display object. The same is true for the easel back and support leg.

Accordingly, a primary feature of the present invention is the provision of a frame system for the presentation of a display object such as photographs, paintings, certificates, and the like in which a display object may be easily positioned, protected, and removed.

Another feature of the present invention is the provision of such a frame system in which all components are of injection molded plastic, including frame face, easel back, support leg, and transparent window pane.

A further feature of the invention is the provision of such a frame system in which all components fit and snap together without use of tools or additional fasteners.

Still another feature of the present invention is the provision of such a frame system in which the main frame and easel back have a simple molded-in, decoupling locking feature with positive feedback, being snap-fitted securely, yet allowing for disassembly and re-use many times.

Yet another feature of the present invention is the provision of such a frame system in which a preferred material for the frame face, polystyrene, is able to accept a large variety of colorants, so frame faces can be transparent with or without color, translucent with or without color, opaque, glow-in-the-dark, molded-in pearlized, mottled, or transparent with glitter or other effects.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

FIG. 15 is a detail perspective view illustrating a male locking feature of the invention;

FIG. 16 is a detail rear elevation view illustrating the male locking feature of the invention;

FIG. 17 is a detail cross section view taken generally along line 17—17 in FIG. 15;

FIG. 18 is a detail cross section view taken generally along line 18—18 in FIG. 8;

FIG. 19 is a detail cross section view taken generally along line 19—19 in FIG. 3 illustrating one relative position of the components;

FIG. 20 is a detail cross section view similar to FIG. 19 illustrating another relative position of the components; and FIG. 21 is a detail view, partly cut away and in section, illustrating a portion of a component shown in FIGS. 19 and 20.

DETAILED DESCRIPTION OF THE PREFERRED EMBODIMENTS

Figure 1:
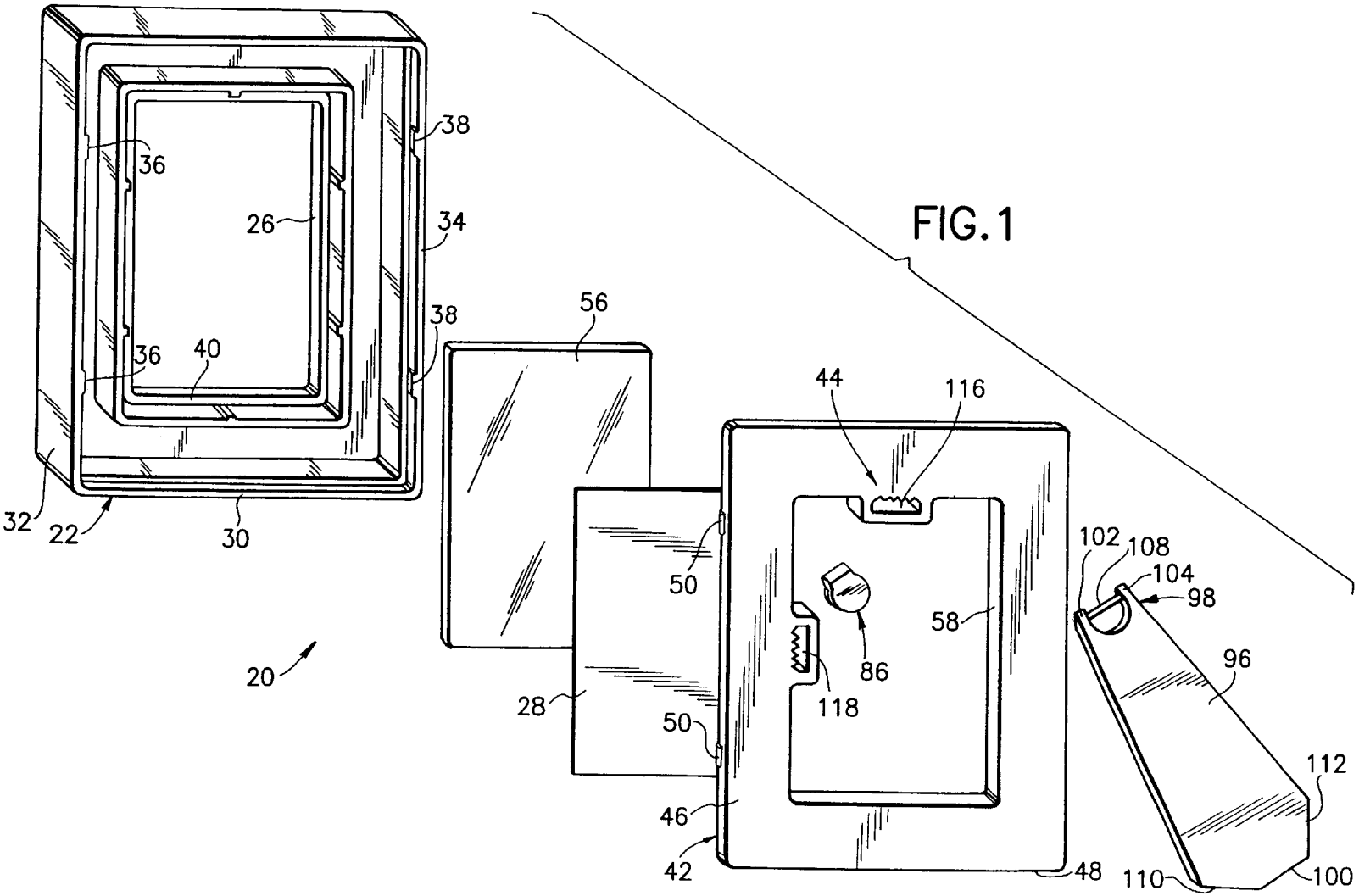
FIG. 1 is a perspective exploded view of an object displaying frame system embodying the invention.

Turn now to the drawings and, initially, to FIG. 1 in which is shown a perspective exploded view of a frame system 20 for object display incorporating features of the present invention. Although the present invention will be described with reference to the embodiments shown in the drawings, it should be understood that the present invention can be embodied in many alternate forms or embodiments. In addition, any suitable size, shape or type of elements or materials consistent with the invention could be used.

Figure 2:
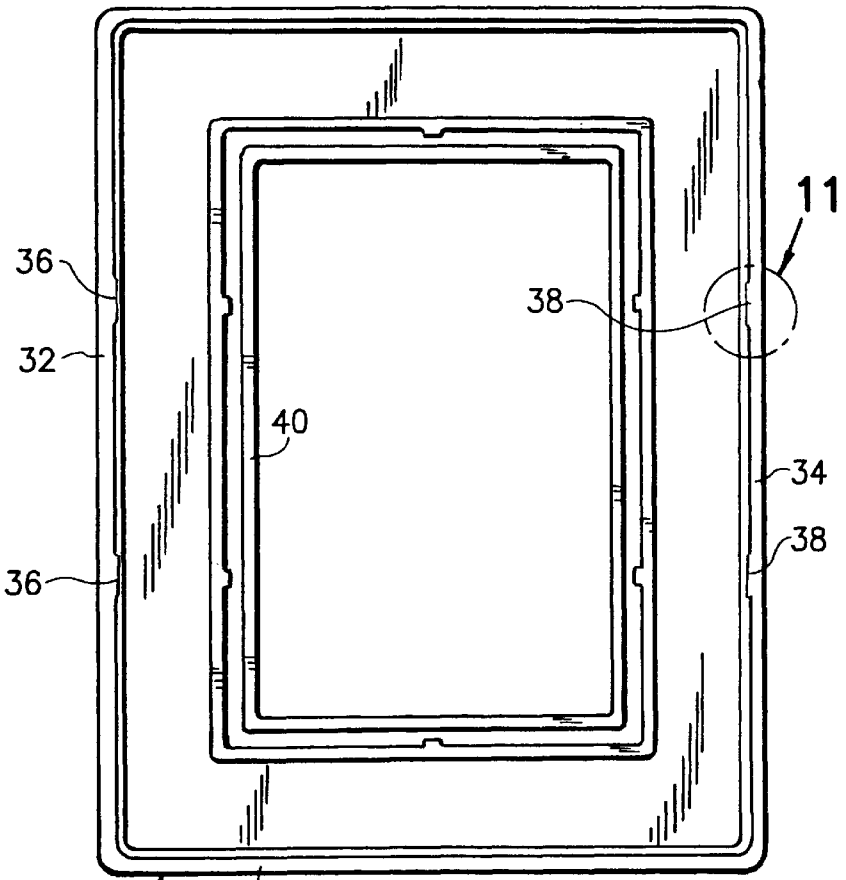
FIG. 2 is a rear elevation view illustrating one component of the invention.

With continuing reference to FIG. 1 and turning also now to FIGS. 2–7, the frame system 20 includes a main frame 22 which, in turn, includes a frame face 24 presented toward the viewer and defining an opening 26 for viewing a display object 28. The main frame is preferably, but not exclusively, fabricated from injection molded polystyrene which is capable of accepting a wide variety of colorants and effects. It will be recognized that the display object may be a photograph, painting, certificate, diploma, or the like which the owner of the frame system 20 wishes to provide for viewing. A peripheral wall 30 projects away from the frame face and has first and second opposed wall segments 32, 34 (FIGS. 1 and 2). The opposed wall segments 32, 34 are merely opposed portions of the peripheral wall 30. It will be understood that while it is desirable for the peripheral wall 30 to be of continuous construction, it may be discontinuous and for purposes of the invention must have at least the opposed wall segments 32, 34. This is for the reason that the wall segments 32, 34 are formed, respectively, with first and second female locking features 36, 38 (FIG. 2) which will be discussed below at greater length.

The main frame 22 also includes a receiving surface 40 for the display object 28. The receiving surface may be in the plane of the face 24 or may be upstanding from the face as illustrated. In any event, taken in its totality, the receiving surface lies in a flat plane so as to conformingly receive the display object 28 which, at least in its mounting regions, is of planar construction.

Figure 3:
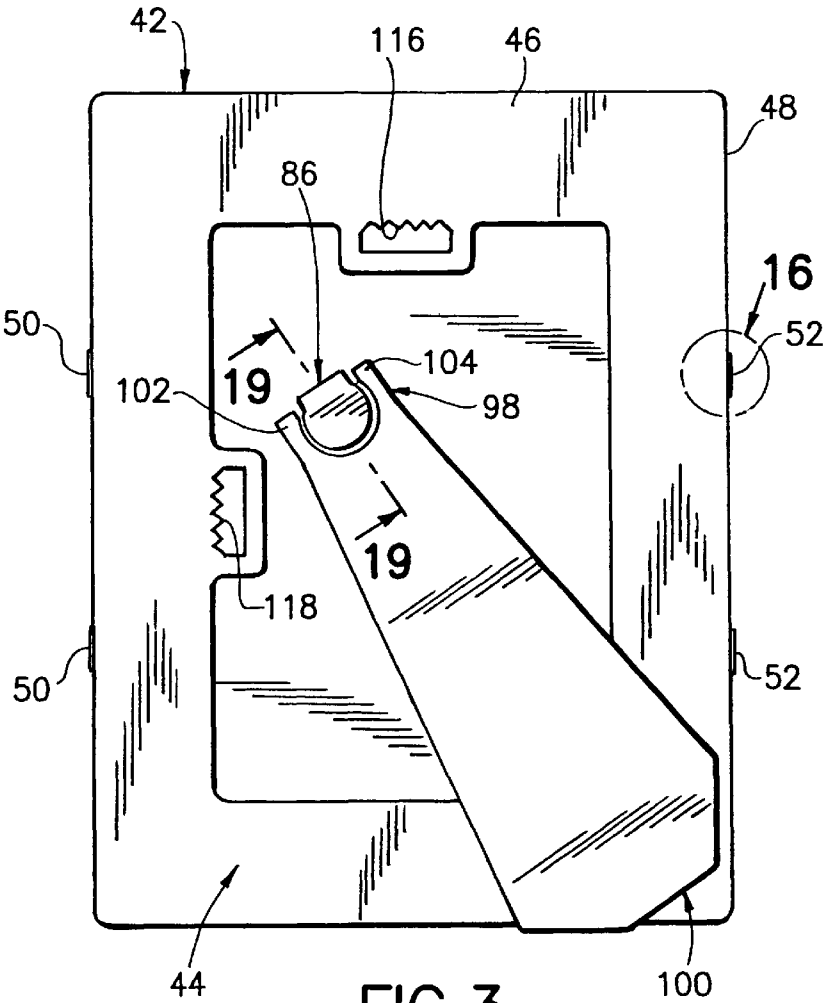
FIG. 3 is a rear elevation view illustrating other components of the invention which matingly join with the component illustrated in FIG. 2.

As seen especially well in FIGS. 1 and 3, the frame system 20 further includes an easel back 42 which is selectively mountable on the main frame 22 and, in turn, includes a support assembly 44 with a planar support panel 46 extending to a peripheral edge 48. First and second opposed male locking features 50, 52 are provided on the peripheral edge 48 so as to be interferingly engageable, respectively, with the female locking features 36, 38 on the peripheral wall 30 when the easel back 42 is mounted onto the main frame 22.

Figure 8:
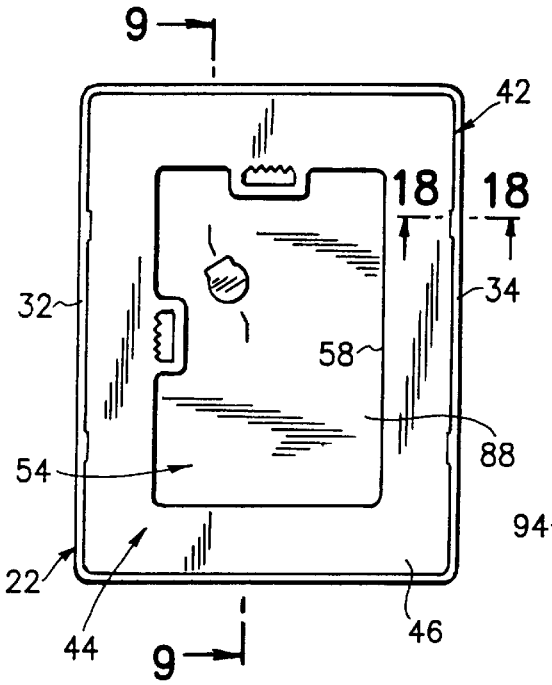
FIG. 8 is a rear elevation view of the frame system of the invention lacking a component.
Figure 9:
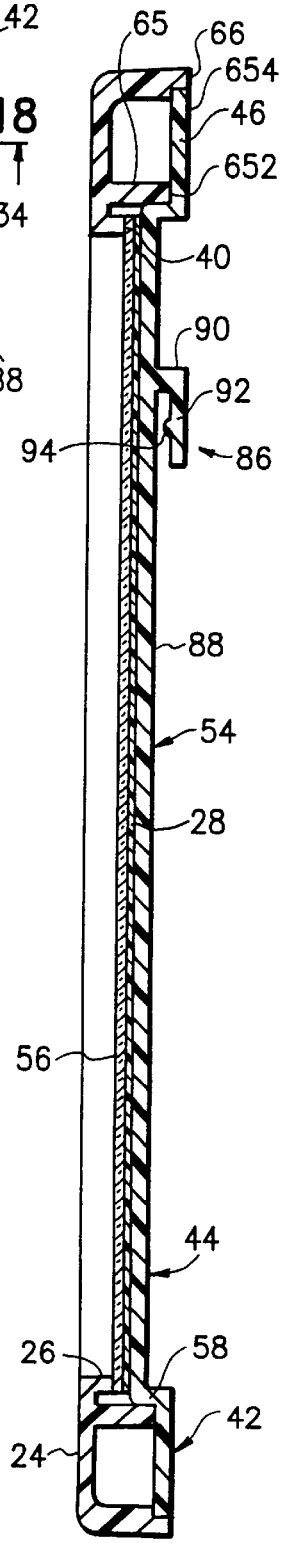
FIG. 9 is a cross section view taken generally along line 9—9 in FIG. 8.

As seen now in FIGS. 8 and 9, the support assembly 44 of the easel back 42 preferably includes a depressed central panel 54 for biasing the display object 28, and possibly an overlying transparent window pane 56 of plastic or glass sheet material, into engagement with the receiving surface 40. In this instance, the central panel 54 lies in a plane parallel with and spaced from the support panel 46 and a web member 58 extends transverse of the planes of the central panel and the support panel and joins the central panel and the support panel.

Figure 10:
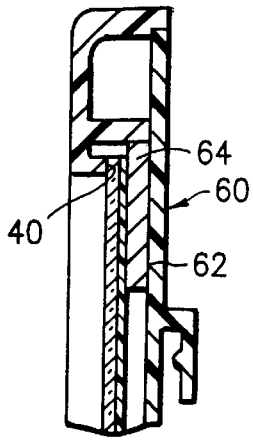
FIG. 10 is a detail cross section similar to a portion of FIG. 9 but illustrating another embodiment of the invention.
Figure 11:
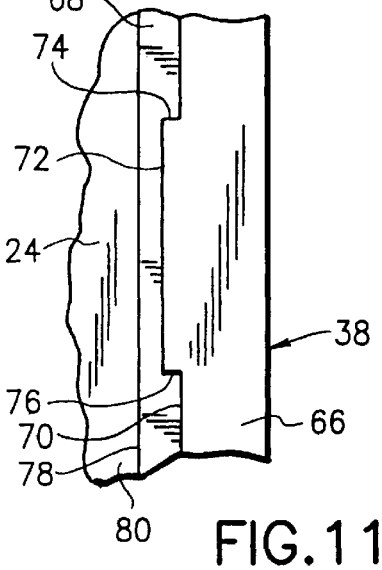
FIG. 11 is a detail rear elevation view illustrating a female locking feature of the invention.
Figure 12:
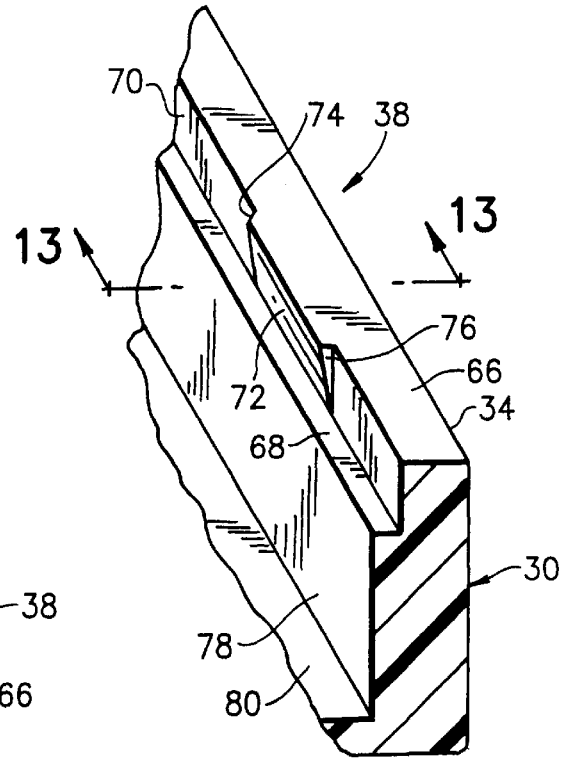
FIG. 12 is a detail perspective view illustrating the female locking feature of the invention.
Figure 13:
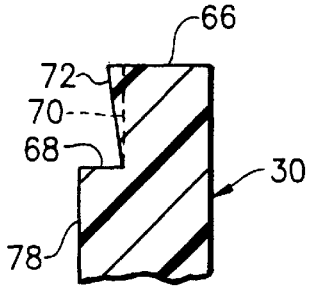
FIG. 13 is a detail cross section view taken generally along line 13—13 in FIG. 12.
Figure 14:
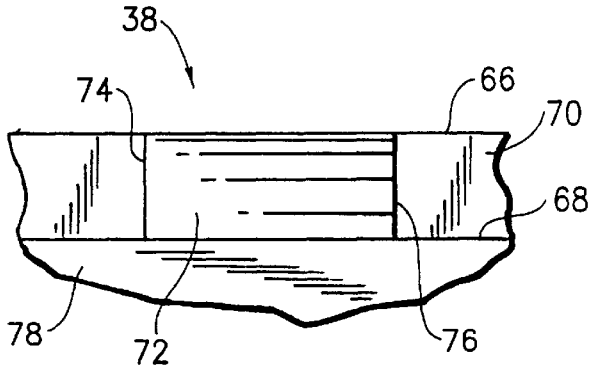
FIG. 14 is a detail side elevation view illustrating the female locking feature of the invention.

In another instance, as seen in FIG. 10, a modified easel back 60 has no central panel 54 and therefore no web member 58. Instead, a modified support panel 62 is planar as it extends between the wall segments 32, 34. A matte 64, or the like, of the type customarily used in the mounting of pictures and certificates in frames may be used to occupy the space between the support panel 62 and the receiving surface 40.

Regardless of whether an easel back 42 or an easel back 60 is employed for the frame system, the main frame 22 includes a support wall 65 (see especially FIG. 9) which projects away from the frame face 24 intermediate the receiving surface 40 and the peripheral wall 30. The support wall 65 has a support surface 652 for engageably receiving the support panel 46 of the easel back when the easel back is mounted on the main frame. Further, the support panel 46 of the easel back has an outer surface 654 which, with the easel back in place, lies substantially in the plane of the upper surface 66 of the peripheral wall 30. This configuration is particularly important when the frame system is hung on an upright supporting surface as will be described below. Turn now to FIGS. 11, 12, 13, and 14 for a more detailed description of the female locking features 36, 38. The female locking features 36, 38 are identical but provided on the opposed but substantially identical wall segments 32, 34. Since FIG. 2 indicates a detail taken from the wall segment 34, the description will be directed to the female locking feature 38. The wall segment 34 has an upper surface 66, a ledge surface 68 lying in a plane parallel to and spaced from the upper surface, and an inner surface 70 lying in a plane transverse of and intermediate the upper surface and the ledge surface. The female locking feature 38 includes a locking surface 72 which projects inwardly away from the peripheral wall 30, or more specifically, from the wall segment 34 with increasing distance away from the frame face 24 and with increasing distance away from the ledge surface 68. Along the inner surface 70, the locking surface 72 extends between opposed edge surfaces 74, 76 and the ledge surface 68 is defined with the aid of a lower inner surface 78 which extends between the ledge surface and a rear side 80 of the frame face 24.

Turning back, momentarily, to FIG. 3, and with the additional aid of FIGS. 15, 16, 17, and 18, each of the male locking features 50, 52 (feature 52 actually illustrated in detail) includes an elongated rib member 82 aligned with the peripheral edge 48 of the easel back 42 for mating engagement with the locking surface 72 of its associated female locking feature 36, 38. With this construction, as the easel back 42 is moved into engagement with the main frame 22 (see the configuration illustrated in FIG. 8), each elongated rib member 80 first engages the upper surface 66 of its associated segment of the peripheral wall 30, then slightly deforms the engaged components to engage the locking surface 72 of the female locking feature 36 or 38, then continues to advance until it comes into engagement with the ledge surface 68 to thereby releasably lock the easel back 42 into engagement with the main frame 22 (FIG. 18).

Thus, the frame system 20 can be readily assembled with the display object 28 in place and can be just as readily disassembled, for example, by firmly holding the wall segments 32, 32 with the fingers of each hand, then pressing on the display object with the thumbs of each hand in a direction away from the frame face 24. With a moderate pressure applied to the display object (or its overlying transparent window pane 54, the locking features 36, 38, 50, and 52 will yield, allowing removal of the easel back 42 from the main frame 22 and of the display object from the receiving surface 40. A replacement display object can then be placed on the receiving surface and the components re-assembled in the manner already described. It will be appreciated that while the easel back may be held properly in place with one set of locking features 36, 38, 50, and 52, multiple sets of these locking features may be desired to optimally mount the easel back to the main frame 22.

Figure 4:
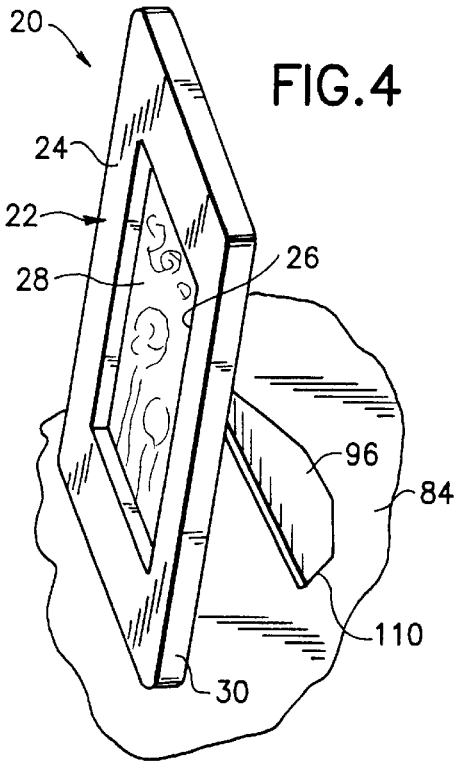
FIG. 4 is a perspective view illustrating use of the invention in a portrait orientation on a supporting surface.
Figure 5:
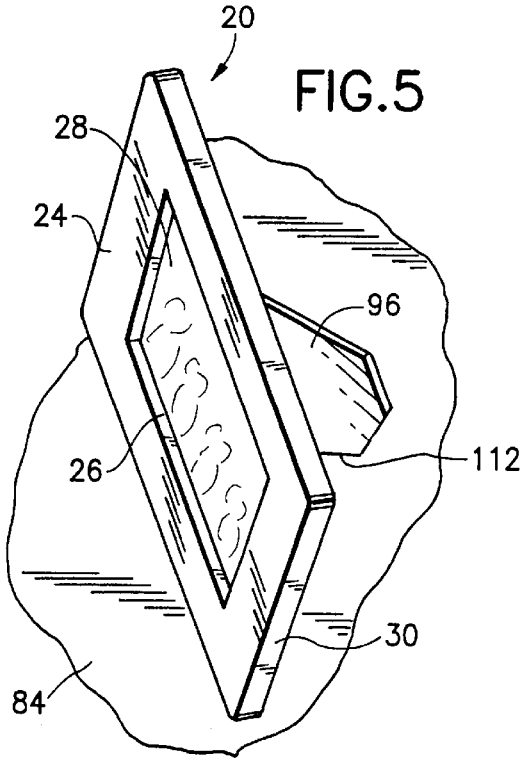
FIG. 5 is a perspective view illustrating use of the invention in a landscape orientation on a supporting surface.

The frame system 20 can be positioned on a level supporting surface 84 in the manner illustrated in FIGS. 4 and 5, a portrait orientation being shown in FIG. 4 and a landscape orientation being shown in FIG. 5. For an explanation of a construction enabling this configuration, turn now especially to FIGS. 1, 3, 9, 19, and 20. It will be appreciated that the central panel 54 has an outer surface 88 facing away from the opening 26 for viewing a display object and away from the frame face 24. A mounting bracket 86 is fixed on the outer surface 88 and includes a base 90 projecting away from the outer surface. The mounting bracket 86 also includes a flange 92 lying in a plane parallel to and spaced from the outer surface 88 and extending away from the base 90. A ridge 94 on the flange 92 generally faces the outer surface 88.

An elongated support leg 96 extends between a mounting end 98 and a free end 100 for selectively mounting the frame system 20 on a substantially level surface as seen in FIGS. 4 and 5. At the mounting end 98, the support leg 96 includes a yoke having a pair of spaced generally parallel longitudinally extending finger members 102, 104, each with a chamfered surface 106 engageable with the outer surface 88. A mounting bar 108 extends between, and is fixed to, the finger members 102, 104. At the free end 100, the support leg 96 is formed with first and second bearing surfaces 110, 112 which are angled relative to each other.

By reason of this construction, the support leg 96 is releasably affixed to the mounting bracket 86 by advancing the mounting end 98 toward the base 90 with the mounting bar 108 proceeding into engagement with the ridge 94 of the flange 92, causing the flange to bend sufficiently to allow the mounting bar to continue to advance and coming to rest between the base and the ridge as seen in FIGS. 19 and 20. The support leg 96 is thereby pivotable about the axis of the mounting bar 108 between a collapsed position adjacent the easel back (FIG. 19) and an operating position (FIG. 20) angularly disposed relative to the easel back with the chamfered surfaces 106 fully engaged with the outer surface 88. As noted earlier, the frame system 20 can be supported on the supporting surface 84 in one orientation (for example, portrait, as seen in FIG. 4) with the peripheral wall 30 and the first bearing surface 110 of the support leg 96 mutually engaging the supporting surface and in another orientation (for example, landscape, as seen in FIG. 5) with the peripheral wall 30 and the second bearing surface 112 of the support leg mutually engaging the supporting surface.

Figure 6:
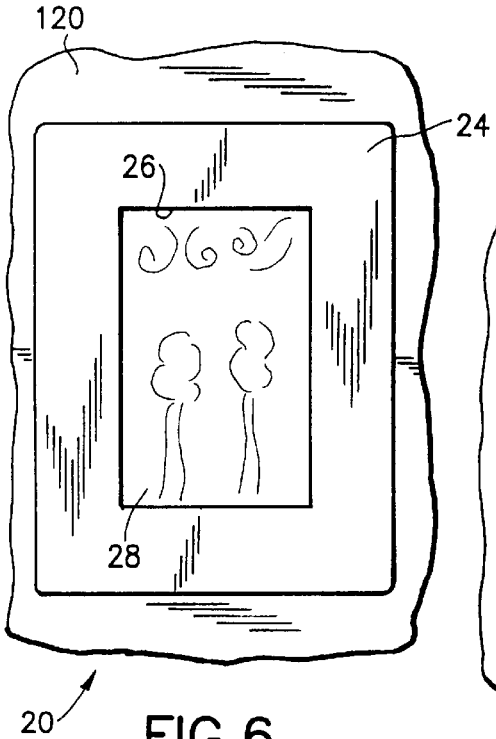
FIG. 6 is a front elevation view illustrating use of the invention in a portrait orientation on an upright mounting surface.
Figure 7:
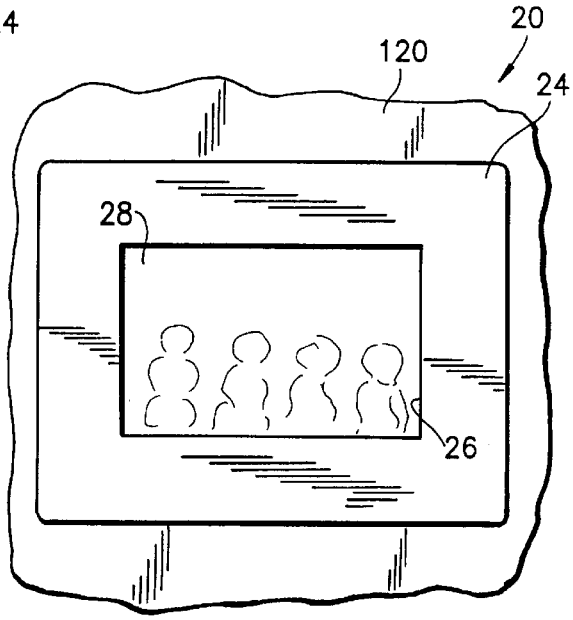
FIG. 7 is a front elevation view illustrating use of the invention in a landscape orientation on an upright mounting surface.

It is preferable that the flange 92 of the mounting bracket 86 have an outer surface 114 which lies in a plane which does not project in a direction away from the opening 26 beyond the plane of the support panel 46. With such a construction, the frame system is enabled to lie flush with an upright surface on which it may be mounted. With this desired end result in mind, the frame system is provided with hanger members which lie in the plane of the support panel 46. More specifically, the easel back 42 is formed with one female hanger member 116 of a generally known construction lying in the plane of the support panel 46 for suspending the frame system in a portrait orientation on an upright mounting surface 120 as seen in FIG. 6 and another hanger member 118 also lying in the plane of the support panel for suspending the frame system on an upright mounting surface in a landscape orientation as seen in FIG. 7.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A frame system for object display comprising:

a central panel for biasing the display object into engagement with the receiving surface; and a web member extending transverse of the planes of the central panel and the support panel and joining the central panel and the support panel.

2. A frame system as set forth in claim 1 wherein each of the first and second opposed segments of the peripheral wall has an upper surface, a ledge surface lying in a plane parallel to and spaced from the upper surface, and an inner surface lying in a plane transverse of and intermediate the upper surface and the ledge surface;

wherein each female locking feature includes a locking surface which projects inwardly away from the peripheral wall with increasing distance away from the frame face; and wherein each of the first and second male locking features includes an elongated rib member aligned with the peripheral edge for mating engagement with the locking surface of its associated female locking feature;

whereby, as the easel back is moved into engagement with the main frame, each elongated rib member first engages the upper surface of its associated segment of the peripheral wall, then slightly deforms the engaged components to engage the locking surface of the female locking feature, then continues to advance until it comes into engagement with the ledge surface to thereby releasably lock the easel back into engagement with the main frame.

3. A frame system as set forth in claim 1 wherein the receiving surface is proximate the opening for viewing a display object; and wherein the main frame includes a support wall projecting away from the frame face intermediate the receiving surface and the peripheral wall, the support wall having a support surface for engageably receiving the support panel of the easel back when the easel back is mounted on the main frame.

4. A frame system as set forth in claim 1 wherein the peripheral wall is continuous and has an upper surface, a ledge surface lying in a plane parallel to and spaced from the upper surface, and an inner surface lying in a plane transverse of and intermediate the upper surface and the ledge surface;

wherein the receiving surface is continuous and generally defines the opening for viewing the display object;

wherein the main frame includes a support wall projecting away from the frame face intermediate the receiving surface and the peripheral wall and generally parallel to the receiving surface, the support wall having a support surface for engageably receiving the support panel of the easel back when the easel back is mounted on the main frame, the support surface lying in a plane parallel with the planes of the peripheral wall and the ledge surface;

wherein the support assembly includes a central panel lying in a plane parallel with and spaced from the support panel and a web member extending transverse of the planes of the central panel and the support panel and joining the central panel and the support panel; and wherein, when the easel back is mounted on the main frame, the support panel adjacent the peripheral edge is engaged with the ledge surface and the peripheral edge is proximate the inner surface, the web member is proximate the support wall, and the central panel engages the display object and biases it into engagement with the receiving surface.

5. A frame system as set forth in claim 4 wherein the support panel has an outer surface which lies substantially in the plane of the upper surface of the peripheral wall.

6. A frame system as set forth in claim 4 including a hanger member lying in the plane of the support panel.

7. A frame system as set forth in claim 4 including;

a first hanger member lying in the plane of the support panel for suspending the frame system in a first orientation; and a second hanger member lying in the plane of the support panel for suspending the frame system in a second orientation.

8. A frame system as set forth in claim 1 wherein at least the main frame is injection molded polystyrene capable of accepting a wide variety of colorants and effects.

9. A frame system as set forth in claim 1 wherein the central panel has an outer surface facing away from the opening for viewing a display object; and including:

a mounting bracket fixed on the outer surface including:

a base projecting away from the outer surface;

a flange lying in a plane parallel to and spaced from the outer surface and extending away from the base; and a ridge on the flange generally facing the outer surface; and an elongated support leg extending between mounting and free ends for selectively mounting the frame system on a substantially level surface including:

at the mounting end, a yoke having a pair of spaced generally parallel longitudinally extending finger members with chamfered surfaces engageable with the outer surface;

a mounting bar extending between and fixed to the finger members; and at the free end first and second bearing surfaces;

whereby the support leg is releasably affixed to the mounting bracket by advancing the mounting end thereof toward the base with the mounting bar proceeding into engagement with the ridge of the flange, causing the flange to bend to allow the mounting bar to continue to advance and coming to rest between the base and the ridge, the support leg being pivotable about an axis of the mounting bar between a collapsed position adjacent the easel back and an operating position angularly disposed relative to the easel back with the chamfered surfaces fully engaged with the outer surface, the frame system being supported on the level surface in one orientation with the peripheral wall and the first bearing surface of the support leg mutually engaging the level surface and in another orientation with the peripheral wall and the second bearing surface of the support leg mutually engaging the level surface.

10. A frame system as set forth in claim 9 wherein the flange has an outer surface which lies in a plane which does not project in a direction away from the opening for viewing a display object beyond the plane of the support panel.

11. A frame system as set forth in claim 9 wherein the support assembly includes:

a central panel for biasing the display object into engagement with the receiving surface; and a web member extending transverse of the planes of the central panel and the support panel and joining the central panel and the support panel.

12. A frame system as set forth in claim 1 wherein the receiving surface, is proximate the opening for viewing a display object;

wherein the main frame includes a support wall projecting away from the frame face intermediate the receiving surface and the peripheral wall, the support wall having a support surface for engageably receiving the support panel of the easel back when the easel back is mounted on the main frame; and including:

a matte interposed between the easel back and the display object on the receiving surface for biasing the display object into engagement with the receiving surface.

* * * * *